US011828072B2

(12) United States Patent
Carpentier et al.

(10) Patent No.: US 11,828,072 B2
(45) Date of Patent: Nov. 28, 2023

(54) PANEL WITH VERTICAL ASSEMBLY FOR PRODUCING A COVERING

(71) Applicant: Gerflor, Villeurbanne (FR)

(72) Inventors: Fabien Carpentier, Bollene (FR); Michel Wengryn, Lapalud (FR)

(73) Assignee: Gerflor, Villeurbanne (FR)

( * ) Notice: Subject to any disclaimer, the term of this patent is extended or adjusted under 35 U.S.C. 154(b) by 0 days.

(21) Appl. No.: 17/311,380

(22) PCT Filed: Dec. 2, 2019

(86) PCT No.: PCT/FR2019/052893
§ 371 (c)(1),
(2) Date: Jun. 7, 2021

(87) PCT Pub. No.: WO2020/115415
PCT Pub. Date: Jun. 11, 2020

(65) Prior Publication Data

US 2022/0025656 A1 Jan. 27, 2022

(30) Foreign Application Priority Data

Dec. 7, 2018 (FR) ..... 1872489

(51) Int. Cl.
*E04F 15/02* (2006.01)
*E04F 13/08* (2006.01)
*E04F 15/10* (2006.01)

(52) U.S. Cl.
CPC .... *E04F 15/02038* (2013.01); *E04F 13/0894* (2013.01); *E04F 15/105* (2013.01);
(Continued)

(58) Field of Classification Search
CPC ..... E04F 15/02038; E04F 13/0894; E04F 2201/0138; E04F 2201/042; E04F 2201/043; E04F 2201/03; E04F 2201/041
See application file for complete search history.

(56) References Cited

U.S. PATENT DOCUMENTS 6,216,409 B1 * 4/2001 Roy ..... E04F 15/04 52/592.4
7,131,242 B2 * 11/2006 Martensson ..... E04F 15/02 52/592.1

(Continued)

FOREIGN PATENT DOCUMENTS

EP 1350904 10/2003
FR 2808824 A1 * 11/2001 ..... E04F 13/0878

(Continued)

*Primary Examiner* — Gisele D Ford

(57) ABSTRACT

A panel (1) having a blade or slab shape, preferably made of a plastic material for producing a floor or wall covering, said panel (1) comprising two pairs of opposite sides defining four edges, two edges of which comprise male coupling means (2), and two edges comprise complementary female coupling means (3), the kinematics of assembling of two adjacent panels (1) being vertical, characterized in that:

the male coupling means (2) comprise two parallel grooves extending along the edge and opening onto a bottom face of the panel (1), so as to define an internal male groove (2*a*), an external male groove (2*b*), an internal male stud (2*c*), and an external male stud (2*d*);

the female coupling means (3) comprise two parallel grooves extending along the edge and opening on an upper face of the panel (1), so as to define a female internal groove (3*a*), a female external groove (3*b*), a female internal stud (3*c*), and a female external stud (3*d*);

the male coupling means (2) comprise two lugs (4) and/or notches (5) and the female coupling means (3) comprise two complementary notches (5) and/or lugs (4) forming, after assembly of two adjacent panels (1), stoppers against a vertical displacement between two assembled adjacent panels (1).

12 Claims, 3 Drawing Sheets

(52) U.S. Cl.
CPC . *E04F 2201/0138* (2013.01); *E04F 2201/042* (2013.01); *E04F 2201/043* (2013.01)

(56) References Cited

U.S. PATENT DOCUMENTS

| | | | | |
|---|---|---|---|---|
| 7,543,418 | B2 * | 6/2009 | Weitzer | E04F 15/04 52/592.1 |
| 2007/0022689 | A1 * | 2/2007 | Thrush | E04F 13/18 52/392 |
| 2011/0247285 | A1 * | 10/2011 | Wybo | B29C 66/12423 264/211.13 |
| 2014/0215946 | A1 * | 8/2014 | Roy | E04F 15/02 52/309.1 |
| 2017/0284105 | A1 * | 10/2017 | Ceysson | E04F 15/105 |

FOREIGN PATENT DOCUMENTS

| | | | | |
|---|---|---|---|---|
| FR | 3024990 | A1 * | 2/2016 | E04F 15/02038 |
| WO | WO-2012136021 | A1 * | 10/2012 | E04F 15/02038 |
| WO | WO 2016/030627 | | 3/2016 | |

* cited by examiner

PANEL WITH VERTICAL ASSEMBLY FOR PRODUCING A COVERING

RELATED APPLICATIONS

This application is a National Phase of PCT Patent Application No. PCT/FR2019/052893 having International filing date of Dec. 2, 2019, which claims the benefit of of France Patent Application No. 1872489 filed on Dec. 7, 2018. The contents of the above applications are all incorporated by reference as if fully set forth herein in their entirety.

FIELD AND BACKGROUND OF THE INVENTION

The present invention relates to the field of floor or wall coverings, and more specifically to a polyvinyl chloride panel in blade or slab shape for producing of such coverings.

Generally speaking, this type of panel has two pairs of opposite sides which define four edges, two of which comprise male coupling means, and two of which comprise complementary female coupling means, in order to assemble two adjacent panels according to a vertical kinematics.

In the field of floor or wall coverings, it is well known to use panels which include complementary male and female coupling means.

For example, according to document WO2016/030 627, on behalf of the applicant, a floor panel for producing a covering comprises:

- male coupling means made of a so-called proximal groove intended to open onto a bottom face of the panel, and of a flexible distal tab intended to extend at one end of an edge of the panel towards the bottom face thereof;
- female coupling means consisting of a proximal groove intended to open on an upper face of the panel and a flexible distal tab intended to extend at an end of an opposite edge of the panel, towards the upper face of said panel.

According to this state of the art, the flexible distal tab of the male coupling means has a proximal wall that is inclined at a first angle relative to a downwardly and outwardly vertical plane, and the flexible distal tab of the female coupling means has a proximal wall inclined at a second angle relative to an upwardly and outwardly vertical plane.

According to another characteristic, the distal tab of at least one of the male or female coupling panels has a distal wall including a notch or lug which is formed to cooperate with a notch or lug arranged on a proximal wall of the corresponding female or male coupling means proximal groove of an adjacent panel, to make a stopper, preventing vertical movement of the panel from occurring relatively to the adjacent panel.

To reduce the locking strain, the flexible distal tab of the female coupling means has a chamfered part intended to form an angle of between 2° and 20° relative to the main plane of the panel, allowing to form a bend in the flexible distal tab so that it is easier to connect two adjacent panels together.

The panel disclosed in this prior art shows good resistance to the vertical disassembly, but its resistance can significantly be improved with respect to its resistance to the horizontal disassembly. The solution implemented to overcome this issue, and thus resist the passage of heavy loads, such as forklifts, is to glue the panel to the area to be coated. This solution is not appropriate because the installation becomes long and complex.

Document EP1350904 of the prior art is also known, which describes a panel for producing a covering comprising male-female coupling means, the male coupling means being made up of two studs cooperating with two grooves. One of the studs has a lug which is cooperating with a notch. The stud of the male coupling means is positioned on the inner side of the panel and has a shape that prevents horizontal disassembly, in particular a truncated cone shape.

In addition to the complexity of the profile of the male coupling means, which weakens the external stud, the locking effect of said external stud can be significantly improved.

Furthermore, it is also known that two adjacent panels can be joined via complementary dovetail shapes, which maximizes the bearing surfaces between the complementary coupling means and thus the resistance to the horizontal disassembly.

However, the process of manufacturing the complementary dovetail coupling means is slow, as it is done by die-cutting. In addition, the complementary coupling means are visible on the surface of the panel, which is detrimental to the overall floor covering's aesthetic.

SUMMARY OF THE INVENTION

One of the objectives of the present invention is then to overcome the above-mentioned disadvantages by offering a vertically assembled panel for producing a covering, which has an optimal resistance to the horizontal disassembly, in particular to resist the passage of heavy loads, while presenting a good locking effect, as well as a satisfying aesthetic.

To this aim, a panel having a blade or slab shape has been developed, preferably made of a plastic material for producing a floor, wall or possibly ceiling covering. The panel comprises two pairs of opposing sides defining four edges, two edges of which comprise male coupling means, and two edges comprising complementary female coupling means. The assembly kinematics of two adjacent panels is vertical.

According to the invention:

- the male coupling means comprise two parallel grooves extending along the edge and opening onto a bottom face of the panel, so as to define a male internal groove, a male external groove, a male internal stud, and a male external stud;
- the female coupling means comprise two parallel grooves extending along the edge and opening onto an upper face of the panel, so as to define a female internal groove, a female external groove, a female internal stud, and a female external stud;
- the male coupling means comprise two lugs and/or notches and the female coupling means comprise two additional notches and/or lugs which are forming, after assembly of two adjacent panels, stops against a vertical motion between two adjacent assembled panels.

As a result, the presence of the two studs at the level of the male and female coupling means significantly improves the strain required for the horizontal disassembly of two adjacent assembled panels. In addition, the two pairs of lugs/notches provide good resistance to vertical disassembly.

Furthermore, the male and female grooves have external walls intended to be in contact two by two after assembly of two adjacent panels in order to improve the resistance to the horizontal disassembly of the two panels.

Preferably, the external female stud comprise a chamfered portion at the bottom face of the panel and forming an angle comprised between 2° and 20° relative to the bottom face of the panel. The chamfered part allows the female outer stud to be lowered during the assembly of two adjacent panels to come into contact with the floor, by deformation, and therefore provide an assembly requiring less strain.

In order to balance the stresses in the thickness of the panel during a horizontal disassembly force, the outer male and female studs present thicknesses less than or equal to the thicknesses of the inner male and female studs. In particular, the greater thickness of the inner studs balances the two sides of the assembly means to prevent disassembly.

The male and female studs can be either straight or inclined towards the outside or inside of the panel. However, in order to simplify the machining operation of the male and female coupling means, the male and female studs are inclined towards the outside of the panel. Furthermore, this characteristic facilitates the assembly of two panels together because the grooves open more easily when the studs are inserted.

Preferably, the male and/or female studs are tilted at an equal angle, in order to facilitate machining, and are inclined, for example, at an angle of between 1° and 45°, and preferably ranging between 5° and 15°.

In accordance with different embodiments, the lugs or notches are provided on an outer wall of the outer male and/or female stud, and complementarily on an inner wall of the inner female and/or male groove.

Alternatively or in combination, the lugs or notches are provided on an outer wall of the male inner stud, and complementarily the notches or lugs are provided on an outer wall of the female inner stud.

BRIEF DESCRIPTION OF THE SEVERAL VIEWS OF THE DRAWINGS

With the intention of better showing another advantages and characteristics in the following description, according to the invention, several alternative forms of embodiment will be described, given as an example without any limitative character, with reference to the annexed drawings wherein.

DESCRIPTION OF SPECIFIC EMBODIMENTS OF THE INVENTION

Referring to FIGS. 1 to 5, the invention relates to a panel (1) for producing a covering, for example of a floor, a wall or possibly a ceiling.

In a specific application, the panel (1) according to the invention is used to make floor coverings and is advantageous in that it shows an optimal horizontal disassembly resistance, i.e., for example, greater than 660N/10 cm, allowing it in particular to withstand the passage of heavy loads, such as the passage of forklifts.

The floor panel (1) according to the invention is preferably made of a plastic material, such as polyvinyl chloride, for example plasticized, and possibly including a mineral filler. However, it is obvious that the panel (1) according to the invention can be made of any suitable plastic material.

According to a specific embodiment, the panel as per the invention is resilient, for example made of a plasticized or rigid polyvinyl chloride.

The panel preferably relates to a core bonded to a decorative coating made of a decorative sheet bonded to a transparent surface layer.

The core may be single or multi-layered, and may be made, for example, from plastic material such as polyvinyl chloride, polypropylene, polyurethane, thermoplastic polyurethane, polyethylene, polyethylene terephthalate, or any other suitable plastic material, and may eventually include fillers in the form of fibers, wood chips, dust or sawdust and/or mineral fillers, e.g., chalk, lime, talc, and one or more plasticizers in order to define the core's rigidity.

The core, or a core layer in the event of a multi-layer core, may potentially be based on urea formaldehyde or melamine formaldehyde and wood, e.g., layers of medium density fiber (MDF) or high density fiber (HDF). Each layer can also be a layer of laminated wood, of wood plastic composite (WPC).

Each layer can be compact or foamed. For example, the core can be made from a foamed layer of rigid polyvinyl chloride sandwiched between two layers of compact rigid polyvinyl chloride.

Figure 1:
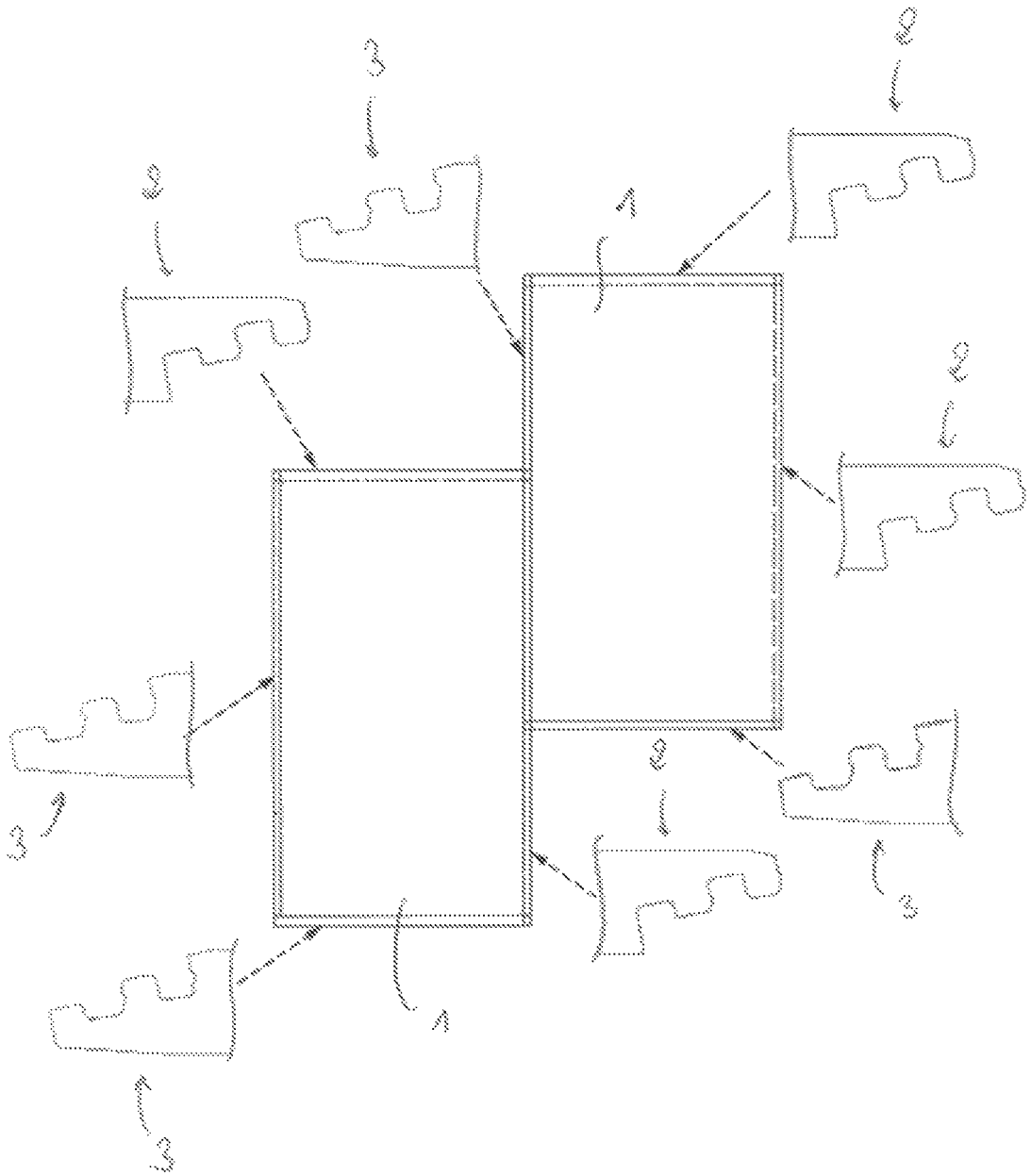
FIG. 1 is a schematic representation of two panels according to the invention, with male coupling means on two adjacent sides, and female coupling means on two opposite adjacent sides.
Figure 2:
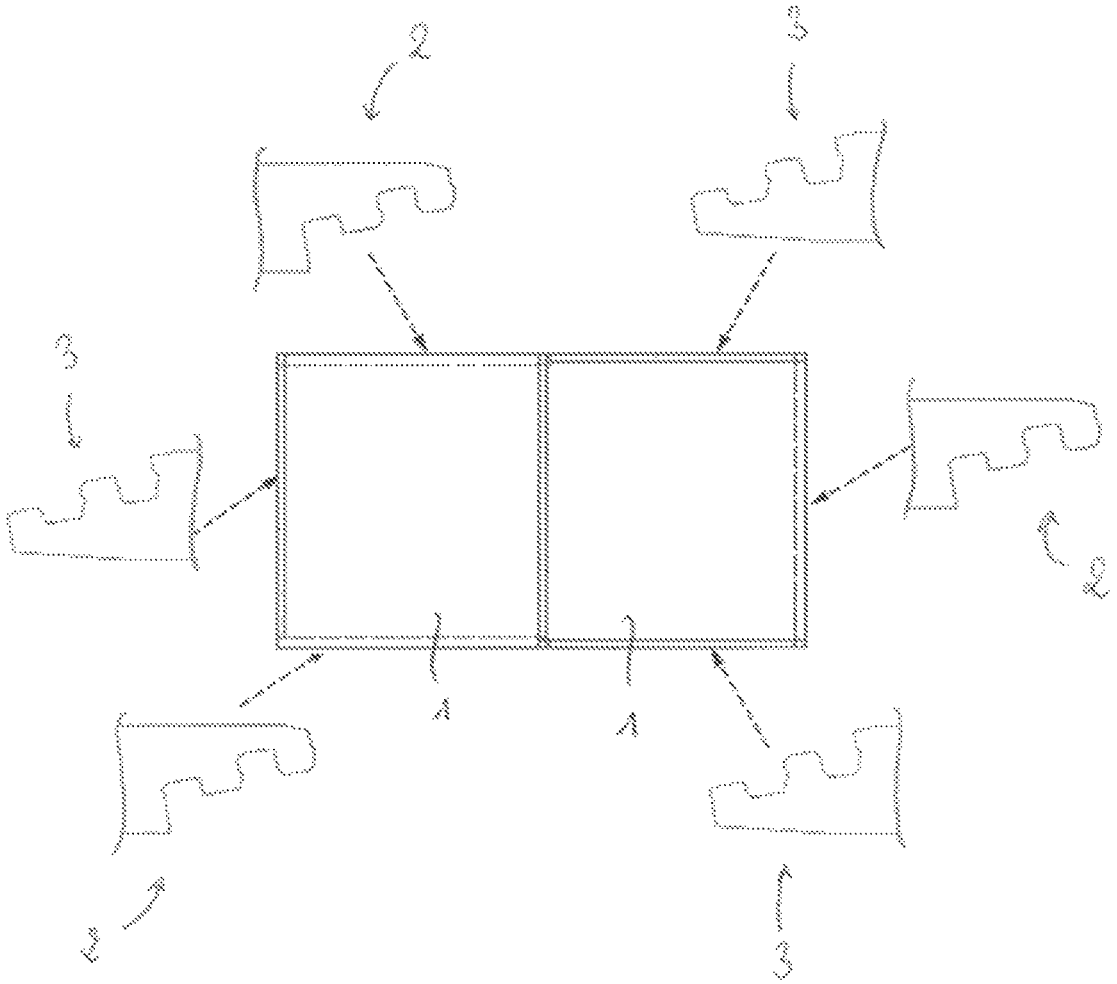
FIG. 2 is a schematic representation of two panels according to the invention, with male coupling means on two adjacent sides, and female coupling means on two adjacent opposite sides.

Commonly and referring to FIGS. 1 and 2, the panel (1) comprises a rectangular or square shape and comprises two pairs of opposite sides defining four edges. Two edges of the panel (1), adjacent (FIG. 1) or opposite (FIG. 2), comprise male coupling means (2), while the other two edges comprise complementary female coupling means (3).

Figure 5:
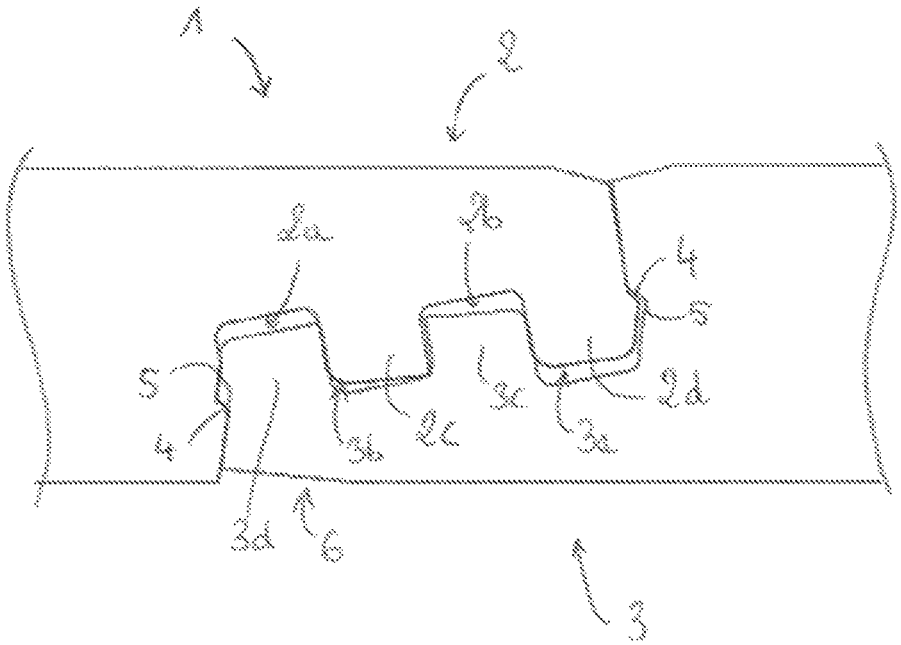
FIG. 5 is a partial cross-sectional view of two panels according to the second embodiment of the male and female coupling means illustrated in FIG. 4, the two panels being assembled.

With reference to FIG. 5, the male (2) and female (3) coupling means allow two adjacent panels (1) to be assembled together according to a vertical kinematic so as to complete the covering. After assembly, the upper and opposite edges of two panels (1) are preferably in contact for an optimum aesthetic appearance.

Figure 3:
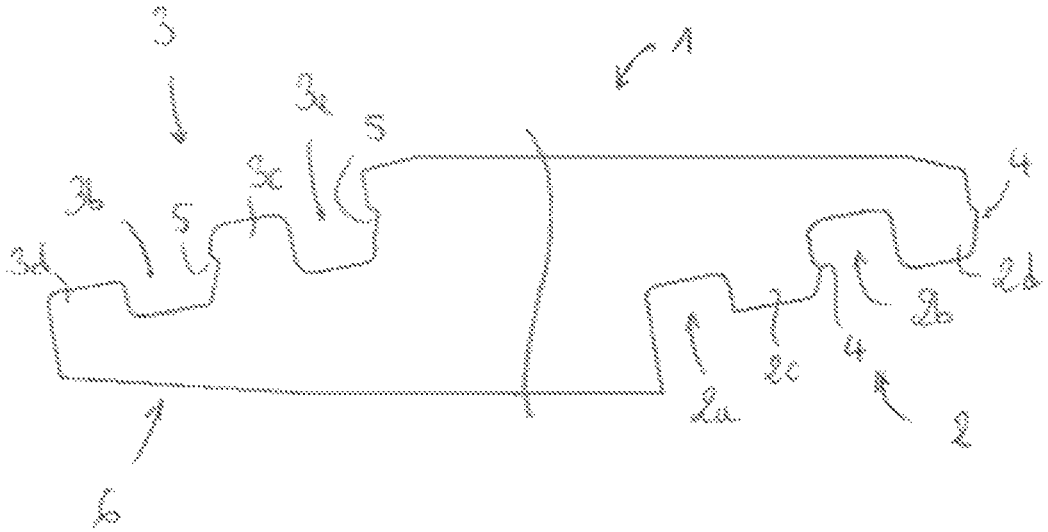
FIG. 3 is a partial cross-sectional view of a first embodiment of the male and female coupling means of the same panel.
Figure 4:
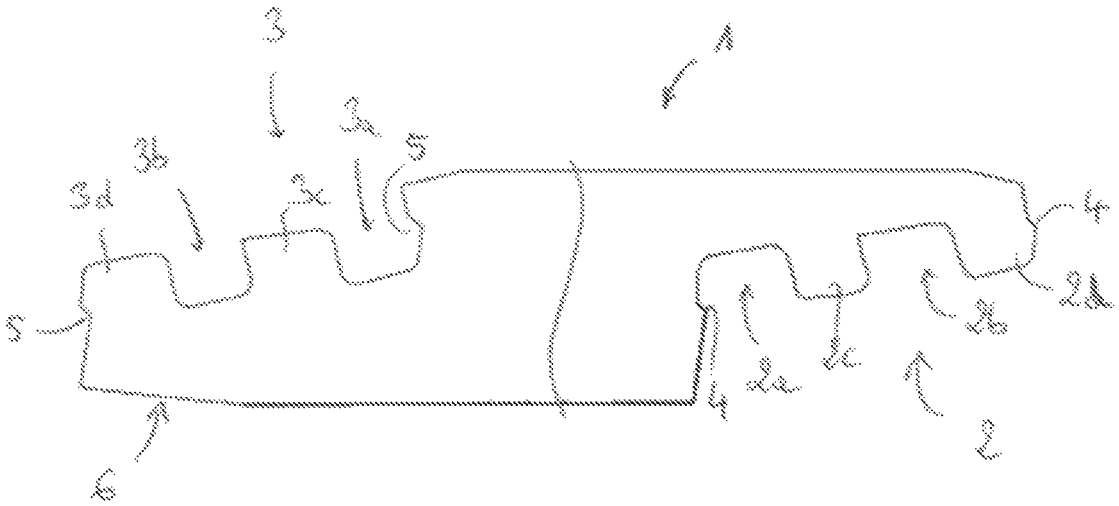
FIG. 4 is a partial cross-sectional view of a second embodiment of the male and female coupling means of the same panel.

According to the invention and with reference to FIGS. 3 to 5, the male coupling means (2) comprise two parallel grooves extending along the edge and opening on a bottom face of the panel (1), so as to define an internal male groove (2*a*), an external male groove (2*b*), an internal male stud (2*c*), and an external male stud (2*d*). By "internal" is meant at the side of the body of the panel (1) inward, and by "external" is meant at the side of the panel (1) outward.

Correspondingly, the female coupling means (3) are complementary and also comprise two parallel grooves extending along the edge and opening on an upper face of the panel (1), so as to define a female internal groove (3*a*), a female external groove (3*b*), a female internal stud (3*c*), and a female external stud (3*d*).

The male (2*c*, 2*d*) and female (3*c*, 3*d*) studs comprise substantially rectangular cross-sections, and are flexible and elastically deformable to allow their engagement into the corresponding female (3*a*, 3*b*) and male (2*a*, 2*b*) grooves.

From the above and with reference to FIG. 5, when assembling two panels (1) together, the male coupling means (2) of a first panel (1) are intended to fit into the female coupling means (3) of a second panel (1), in particular in accordance with a vertical kinematics.

The presence of the two studs at the level of the male (2) and female (3) coupling means allows to significantly improve the strain required for the horizontal disassembly of two panels (1). Horizontal disassembly means exerting a tensile strength on each of the panels (1), parallel to the plane defined by the panels (1), in order to move them apart from each other. Such tensile strength is exerted, for example, for a floor covering, when heavy loads travel over two adjacent panels (1), at the boundary between said two panels (1), for example when a forklift truck passes over, and for a wall covering, this strength is mainly exerted by the force of gravity.

In order to further improve the resistance to the horizontal disassembly of two panels (1) and with reference to FIG. 5, the male (2*a*, 2*b*) and female (3*a*, 3*b*) grooves each have external walls, i.e. located not on the side of the body of the panel (1), but on the side of the outside of the panel (1), intended to be in two by two contact, after assembly of the two panels (1). In order to obtain the two by two contact, the grooves and studs have appropriate widths and/or inclinations. For example, the studs and grooves are about 2 mm wide, and have a 10° inclination relative to a vertical direction and towards the outside of the panel. More specifically, the panel shown in FIG. 4 has a female outer stud (3*d*) with a width of 2.02 mm, a female inner stud (3*c*) with a width of 1.95 mm, a male inner groove (2*a*) with a width of 2 mm, and a male outer groove (2*b*) with a width of 1.98 mm.

The two by two contact means that the outer walls of the male grooves (2*a*, 2*b*) are in contact with the outer walls of the female grooves (3*a*, 3*b*). In practice, after assembly these contacting walls are parallel to each other. After assembly, and in a preferential approach, at least one male stud (2*c*, 2*d*) is in contact with the bottom of the corresponding female groove (3*b*, 3*a*) in order to have a vertical support. Moreover, after assembly, there is still a clearance of a few tenths of a millimeter between the external vertical wall of the external female stud (3*d*), located under the notch (5), and the vertical wall facing the internal male groove (2*a*), located under the lug (4). This characteristic facilitates the assembly.

Always according to FIG. 4, the external and internal vertical walls of the internal female stud (3*c*) as well as the internal vertical wall of the external vertical stud (3*d*) are both inclined towards the outside of the panel while the external vertical wall of the external vertical stud (3*d*) is inclined towards the inside of the panel, for example at an angle comprise between 1° and 5°, preferably 3°. This combination of inclinations facilitates the assembly of the female outer stud (3*d*) and the male inner groove (2*a*).

The assembly will be easier as the angles of inclination of the vertical walls of the internal stud (3*c*) as well as the internal vertical walls of the external stud (3*d*) will be almost vertical, to the detriment of the resistance to vertical unlocking. Most preferably, these three walls are parallel to each other in order to minimize the deformation of the grooves during assembly. Preferably, the walls of the corresponding grooves comprises the same angle of inclination.

In the configuration shown in FIG. 4, the external and internal vertical walls of the internal female stud (3*c*) as well as the internal vertical wall of the external vertical stud (3*d*) can thus be parallel and be inclined at an angle comprised between 3° and 10°, preferably of 5° towards the outside of the panel. This is particularly advantageous if the material used to make the panel core is not flexible enough for the grooves and studs to deform elastically when the panels are assembled.

In order to form stoppers against a vertical movement between two assembled panels (1), and to contribute to the resistance against the vertical disassembly, the male coupling means (2) comprise two lugs (4) and/or notches (5), and the female coupling means (3) comprise, in a complementary way, two complementary notches (5) and/or lugs (4) forming, after assembly of the two panels (1), the stoppers.

Thus, several embodiments are possible. For example, the male coupling means (2) comprise either two lugs (4), or two notches (5), or a lug (4) and a notch (5), formed to cooperate complementarily with either two notches (5), or two lugs (4), or a notch (5) and a lug (4), provided on the female coupling means (3).

For example, the lugs (4) or notches (5) are provided on an outer wall of the outer male (2*d*) and/or female (3*d*) stud, and complementarily on an inner wall of the inner female (3*a*) and/or male (2*a*) groove.

Furthermore, in a combined embodiment, the lugs (4) or notches (5) are, for example, provided on an outer wall of the male inner stud (2*c*), and complementarily on an outer wall of the female inner stud (3*c*).

Therefore, according to a first embodiment illustrated in FIG. 3, the male coupling means (2) comprise a lug (4) provided on the outer wall of the male inner stud (2*c*), and a lug (4) provided on the outer wall of the male outer stud (2*d*) and, complementarily, the female coupling means (3) comprises a notch (5) provided on an outer wall of the female inner stud (3*c*), and a notch (5) provided on an inner wall of the female inner groove (3*a*).

In a second embodiment as shown in FIG. 4, the male coupling means (2) comprises a lug (4) provided on the outer wall of the male outer stud (2*d*), and a lug (4) provided on the inner wall of the male inner groove (2*a*) and, complementarily, the female coupling means (3) comprises a notch (5) provided on an inner wall of the female inner groove (3*a*), and a notch (5) provided on an outer wall of the female outer stud (3*d*).

Of course, other embodiments can be considered with different notch (5)/lugs (4) combinations, without exceeding the scope of the invention.

According to another characteristic of the invention, the female external stud (3*d*) comprises a chamfered portion (6) at the level of the bottom face of the panel (1) and forming an angle comprised between 2° and 20° with the bottom face of the panel (1). Thus, during the assembly of the two adjacent panels (1), the chamfered portion (6) allows the lowering of the external female stud (3*d*) to come, by deformation, into contact with the ground, and thus decrease in the assembly strain. The chamfered part (6) can extend under the external female stud (3*d*), or even under the external female groove (3*b*), or even up to the internal female groove (3*a*), in order to facilitate the assembly by increasing the flexibility of the whole.

Moreover, the upper face of the panel (1) can also have chamfers at the level of the external male stud (2) and the internal female groove (3*a*) in order to contribute to the general aesthetics of the panels (1), after assembly. Each chamfer forms an angle comprised between 2° and 20° with respect to the upper face of the panel (1). The interface between the two assembled panels thus forms a V-shaped groove, shown in FIG. 5.

In order to facilitate the assembly of two adjacent panels (1), and in particular the engagement of the male coupling means (2) inside the female coupling means (3), the male (2*c*, 2*d*) and female (3*c*, 3*d*) studs are inclined towards the outside or inside of the panel (1). This characteristic also facilitates the manufacturing, and in particular the machining of the male (2) and female (3) coupling means. In a particular case, the male (2*c*, 2*d*) and female (3*c*, 3*d*) studs could form a sort of dovetail, the external faces being inclined towards the outside and the internal faces towards the inside.

According to different embodiments, the male studs (2*c*, 2*d*) are inclined at the same angle, for example comprised between 1 and 45°, and preferably between 5 and 15°. Similarly, and according to a particular embodiment, the female studs (3*c*, 3*d*) are inclined at the same angle, for example also comprised between 1 and 45°, and preferably between 5 and 15°. Finally, according to a particular embodiment, the male studs (2*c*, 2*d*) are inclined at the same angle as the female studs (3*c*, 3*d*). In FIGS. 3 and 4, the angle of inclination of the male (2*c*, 2*d*) and female (3*c*, 3*d*) studs is 10°.

Also in order to participate in the resistance to the horizontal disassembly, and to also balance the stresses in the thickness of the panel (1) during such a disassembly strain, the male (2*d*) and female (3*d*) outer studs have thicknesses less than or equal to the thicknesses of the male (2*c*) and female (3*c*) inner studs. In other words, the inner posts (2*c*, 3*c*) are thicker than the outer posts (2*d*, 3*d*). Thickness means the height, or the distance between the bottom and upper faces of the panel (1), at the level of said studs.

Another way of characterizing the thickness or height of the studs is to characterize the thickness of the panel (1) between the upper face of the panel (1) and the bottom of the male grooves (2*a*, 2*b*) for the male coupling means (2), and the thickness between the bottom face of the panel (1) and the bottom of the female grooves (3*a*, 3*b*) for the female coupling means (3). Thus, for the female coupling means (3), the thickness between the bottom face of the panel (1) and the bottom of the female outer groove (3*b*) is less than the thickness between the bottom face of the panel (1) and the bottom of the female inner groove (3*a*). Similarly, for the male coupling means (2), the thickness between the upper face of the panel (1) and the bottom of the male outer groove (2*b*) is less than the thickness between the upper face of the panel (1) and the bottom of the male inner groove (2*a*).

The invention preferably applies to a panel (1) having a thickness greater than 4 mm, and preferably comprised between 5 and 10 mm, or even greater.

Generally speaking, the shortest distance or thickness between the bottoms of the male (2*a*, 2*b*) or female (3*a*, 3*b*) grooves and the corresponding upper or bottom face of the panel (1) is comprised between 20% and 60% of the thickness of the panel (1). According to a particular example, the thickness at the bottom of the outer grooves (2*b*, 3*b*) is comprised between 20% and 45% of the thickness of the panel (1), and the thickness at the bottom of the inner grooves (2*a*, 3*a*) is comprised between 20 and 60% of the thickness of the panel (1).

For example, for a panel (1) with a thickness of 6 mm and coupling means as shown in FIG. 3, the thickness at the bottom of the female outer groove (3*b*) is 1.85 mm, while the thickness at the bottom of the female inner groove (3*a*) is 3.08 mm. The thickness at the bottom of the outer male groove (2*b*) is 1.4 mm, while the thickness at the bottom of the inner male groove (2*a*) is 3.08 mm.

Always for example, for a panel (1) with a thickness of 6 mm and coupling means as shown in FIG. 4, the thickness at the bottom of the external female groove (3*b*) is 2.37 mm, while the thickness at the bottom of the internal female groove (3*a*) is 3.11 mm. The thickness at the bottom of the male outer groove (2*b*) is 2.34 mm, while the thickness at the bottom of the male inner groove (2*a*) is 2.66 mm.

According to a particular embodiment, the thicknesses of the male coupling means (2) at the bottoms of the male grooves (2*a*, 2*b*) are equal to the thicknesses of the female coupling means (3) at the bottoms of the female grooves (3*a*, 3*b*).

Strength tests were performed with male (2) and female (3) coupling means having thicknesses of 1.4 mm at the bottoms of the outer grooves (2*b*, 3*b*), and thicknesses of 2.8 mm at the bottoms of the inner grooves (2*a*, 3*a*). A resistance to the vertical disassembly of 1000N/10 cm, and a resistance to the horizontal disassembly of 670N/10 cm were measured. Horizontal and vertical disassembly mechanical properties were determined according to ISO24344 on a Shimadzu Autograph AGS-X tensile tester, on 10 cm by 10 cm samples, at a speed of 10 mm/min.

To measure the vertical disassembly force, the stress is applied perpendicular to the plane formed by the assembled floor covering. The force used is the one observed during the complete disassembly of the assembly means.

To measure the horizontal disassembly force, the stress is applied along the plane formed by the assembled floor covering. The force used is the one observed during the complete disassembly of the assembly means.

It is obvious from the above that the invention provides a vertically assembled panel (1) for making a covering, which has optimum resistance to the horizontal disassembly, in particular to withstand the passage of heavy loads, while having a good locking effect, as well as a satisfactory aesthetic appearance.

The invention claimed is:

1. A panel for producing a floor or a wall covering, said panel comprising:

two pairs of opposite sides defining two male coupling edges and two complementary female coupling edges, the kinematics of assembling of two adjacent panels being vertical;

wherein each of the male coupling edges comprises two parallel grooves extending along the edge and opening onto a bottom face of the panel, so as to define an internal male groove, an external male groove, an internal male stud, and an external male stud;

wherein each of the female coupling edges comprises two parallel grooves extending along the edge and opening on an upper face of the panel, so as to define a female internal groove, a female external groove, a female internal stud, and a female external stud;

wherein each of the male coupling edges comprises two lugs and/or notches and the each of the female coupling edges comprises two complementary notches and/or lugs forming, after assembly of two adjacent panels, stoppers against a vertical movement between two assembled adjacent panels wherein each of the male and female studs:

has a rectangular cross-section which is inclined towards an outside of the panel, and is flexible and elastically deformable to allow engagement of said male and female studs into corresponding female and male grooves.

2. Panel according to claim 1, wherein the female external stud comprises a chamfered part at the bottom face of the panel and forming an angle of comprised between 2° and 20° with respect to the bottom face of the panel, the chamfered part allowing the female external stud to be lowered when assembling two adjacent panels in order to come into contact with the floor by deformation.

3. Panel according to claim 1, wherein the external male and female studs have thicknesses less than or equal to thicknesses of the internal male and female studs.

4. Panel according to claim 1, wherein the male and/or female studs are inclined at a same angle.

5. Panel according to claim 4, wherein the male and/or female studs are inclined at an angle comprised between 1° and 45°.

6. Panel according to claim 1, wherein the lugs or notches are provided on an outer wall of the outer male and/or female stud, and complementarily on an inner wall of the inner female and/or male groove.

7. Panel according to claim 1, wherein the lugs or notches are provided on an outer wall of the male inner stud, and complementarily the notches or lugs are provided on an outer wall of the female inner stud.

8. Panel according to claim 1, wherein the male and female grooves have external walls in contact two by two after assembly of two adjacent panels.

9. Panel according to claim 4, wherein the male and/or female studs are inclined at an angle comprised between 5° and 15°.

10. Panel according to claim 1, wherein in each of the female coupling edges, a thickness between the bottom face of the panel and a bottom of the female outer groove is less than a thickness between the bottom face of the panel and a bottom of the female inner groove.

11. Panel according to claim 10, wherein in each of the male coupling edges, a thickness between the upper face of the panel and a bottom of the male outer groove is less than a thickness between the upper face of the panel and a bottom of the male inner groove.

12. Panel according to claim 4, wherein the male and/or female studs are inclined at an angle comprised between 5° and 15°.

* * * * *